United States Patent [19]

Miyakawa et al.

[11] 4,150,388

[45] Apr. 17, 1979

[54] A-C CHARGED ELECTROSTATIC RECORDING PROCESS

[75] Inventors: Nobuhiro Miyakawa, Kobe; Takashi Yamaguchi, Yokohama; Eiichi Inoue, Tokyo, all of Japan

[73] Assignee: Mita Industrial Company Ltd., Osaka, Japan

[21] Appl. No.: 845,215

[22] Filed: Oct. 25, 1977

[30] Foreign Application Priority Data

Oct. 27, 1976 [JP] Japan ..... 51-129027

[51] Int. Cl.[2] ..... G03G 15/02

[52] U.S. Cl. ..... 346/153

[58] Field of Search ..... 346/153, 165, 164

[56] References Cited

U.S. PATENT DOCUMENTS

| | | | |
|---|---|---|---|
| 2,918,608 | 12/1959 | Rieth | 346/165 |
| 3,434,878 | 3/1969 | Reis | 346/165 |
| 3,713,996 | 1/1973 | Letter | 346/165 |
| 3,778,841 | 12/1973 | Gundlach | 346/153 |
| 3,974,041 | 8/1976 | Haruta | 346/165 |

*Primary Examiner*—Jay P. Lucas

*Attorney, Agent, or Firm*—Sherman and Shalloway

[57] ABSTRACT

In the electrostatic recording process comprising relatively scanning a recording electrode on an electrostatic recording material which is electrically connected between said recording electrode and a counter electrode, applying a high frequency alternating current or asymmetric alternating recording signal formed by amplifying and modulating an image signal by a high frequency carrier wave between said two electrodes to form an electrostatic image on the electrostatic recording material, developing the so formed electrostatic image with a developer and, if desired, fixing the developed image, when a specific dielectric layer is selected to the kind of the recording signal and the electrostatic image formed on the dielectric layer is developed with an electroconductive powdery developer containing a fine powder of a magnetic material, high quality recorded images free of such problems as blurring, tailing, fogging and Moire can be obtained a high recording efficiency.

15 Claims, 10 Drawing Figures

Fig. 1-A
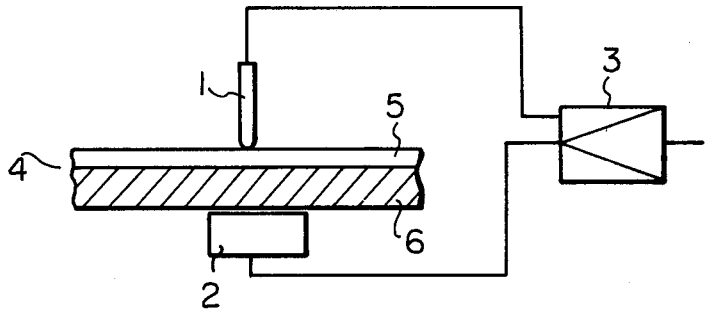
Fig. 1-B
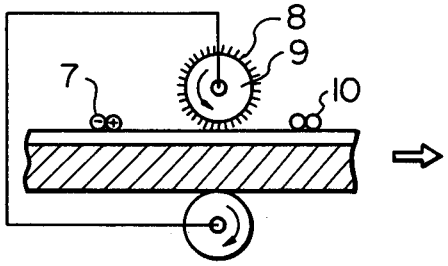
Fig. 1-C
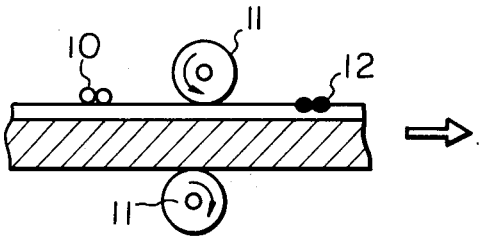

Fig.2-A
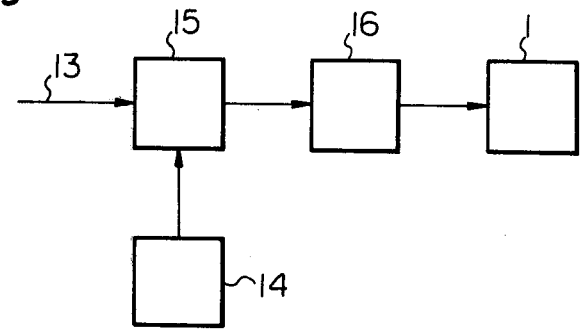
Fig. 3-A
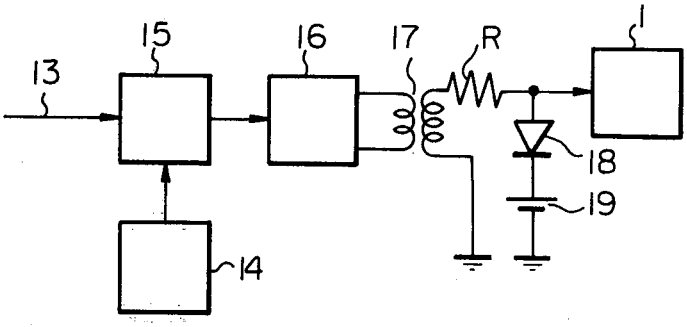
Fig. 4-A
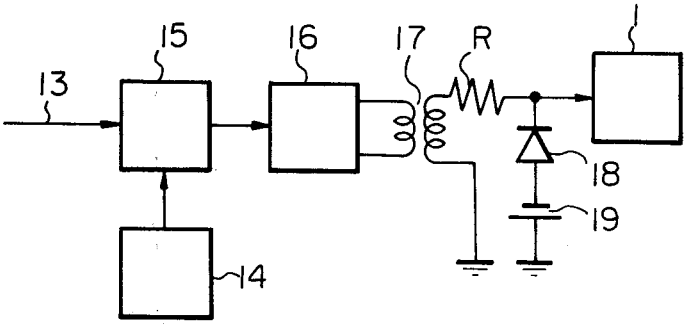

Fig. 2-B
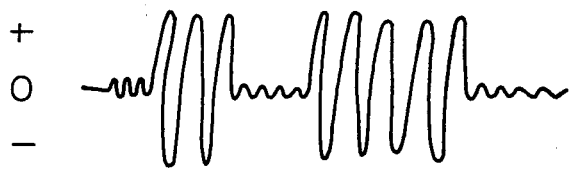
Fig. 3-B
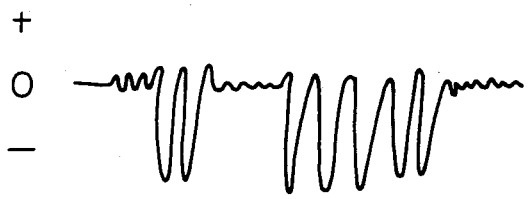
Fig. 4-B
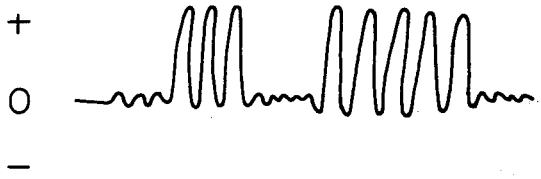

A-C CHARGED ELECTROSTATIC RECORDING PROCESS

BACKGROUND OF THE INVENTION (1) Background of the Invention

The present invention relates to an improvement in the electric recording process. More particularly, the invention relates to an electric recording process using as an electric recording signal a high frequency recording signal of an alternating current or asymmetric alternating current formed by amplifying and modulating an image signal, in which by using, in combination, an electrostatic recording material having a specific dielectric layer and an electroconductive magnetic developer, occurrence of problems such as blurring, tailing, fogging and Moire can be effectively prevented in resulting recorded images and it is possible to obtain visible images having a high density.

(2) Description of the Prior Art

As the conventional electric recording process, there is known a so-called electrostatic recording process comprising moving relatively a pair of a recording electrode and a counter electrode and an electrostatic recording material electrically connected between the two electrodes, applying an electric recording signal between the two electrodes to form an electrostatic latent image on the electrostatic recording material, developing the so formed electrostatic latent image with a developer and, if desired, fixing the developed image.

In general, direct current signals are used as the electric recording signal to be applied in this known electrostatic recording process. However, a high-voltage direct current applied to a recording stylus not only forms a latent image on the recording surface but also causes such problems as so-called "blurring," "tailing" and "fogging". For example, Messrs. Haneda, Ito and Hashigami teach that simultaneously with formation of a latent image as mentioned above, charges of the opposite polarity, which are deemed to be due to influences of induction or electric force lines, are accumulated in the vicinity of the latent image to cause "blurring," when the recording stylus is moved, charges accumulated on the recording stylus and other recording equipments are applied and transferred to the recording surface to cause "tailing." Because of the potential forming the latent image, the entire recording surface is charged at the same polarity as that of the latent image, though the intensity of charging is lower than in the latent image and this charging results in "fogging" (see the Journal of the Electrophotographic Association, April 1970, pages 37 to 43). Accordingly, in a final image obtained by the electrostatic recording process using a high-voltage direct current as the electric recording signal, the resolving power is reduced by the above-mentioned undesirable phenomena such as blurring, tailing and fogging and the image becomes obscure. Further, when recording is carried out at a high speed, namely when the relative scanning speed of the recording stylus and recording material is enhanced, the above defect becomes especially conspicuous.

Methods using as electric recording signals high frequency signals formed by amplifying and modulating image signals have already been proposed in Japanese Patent Publications Nos. 33516/71 and 21311/65. It is taught that according to the method disclosed in the former patent publication, since charges of different polarities are alternately applied, charges oriented in the vertical direction of a recording paper are not formed and a powdery developer is uniformly stuck to either the peripheral portion or the central portion of a latent image on the recording paper, whereby the edge effect is eliminated and an image of good quality is obtained. The latter patent publication discloses that according to the claimed alternating current recording method, the entire circuit structure can be simplified, any developer can be used irrespective of the polarity of the toner and an image having a sufficient resolving power is obtained.

According to the known alternating current recording method, however, since alternating charges in which the polarity is changed alternately at every half cycle are formed on the recording surface, a great number of very fine white spots, namely so-called dots, are formed on a final image, and as a result, the image density is drastically reduced and a Moire fringe, namely a periodical change of the density not present in the original, which is generated at certain beats of dot and line densities depending on the value of the line density, is caused to appear on the final image.

SUMMARY OF THE INVENTION

It was found that in performing electric recording by using the above-mentioned alternating current recording signals, when a dielectric layer comprising a dielectric substance having an electron-acceptive property is selected in case of a recording signal of an alternating current or asymmetric alternating current biased to the negative polarity side and a dielectric layer comprising a dielectric substance having an electron-donative property is selected in case of a recording signal of an asymmetric alternating current biased to the positive polarity side and when an electrostatic latent image formed on such dielectric layer by the above-mentioned alternating current recording method is developed with a magnetic electroconductive powdery developer detailed hereinafter, all of the foregoing defects such as blurring, tailing, fogging and Moire can be eliminated at a stroke and a clear recorded image having a high density can be obtained. We have now completed the present invention based on this finding.

It is therefore a primary object of the present invention to provide an electric recording process characterized by a novel combination of an alternating recording current, a specific dielectric layer and a magnetic electroconductive powdery developer.

Another object of the present invention is to provide an electric recording process in which such problems as blurring, tailing, fogging and Moire can be effectively eliminated and an image excellent in the density, contrast, resolving power and gradation can be obtained.

Still another object of the present invention is to provide an electric recording process in which electric recording can be performed at a scanning speed much higher than the scanning speeds adopted in the known electric recording processes.

In accordance with the fundamental aspect of the present invention, there is provided an electric recording process comprising relatively moving a pair of a recording electrode and a counter electrode and an electrostatic recording material electrically connected between said two electrodes, applying a high frequency alternating current or asymmetric alternating current recording signal by a high frequency carrier wave formed by amplifying and modulating an image signal between said two electrodes to form an electrostatic image on the electrostatic recording material, developing the so formed electrostatic image with a developer and, if desired, fixing the developed image, said process being characterized in that said electrostatic recording material comprises an electroconductive layer and a dielectric layer, when said recording signal is a signal of an alternating current or asymmetric alternating current biased to the negative polarity side, a dielectric layer comprising a dielectric substance having an electron-acceptive property is selected as the dielectric layer and when said recording signal is a signal of an asymmetric alternating current biased to the positive polarity side, a dielectric layer comprising a dielectric substance having an electron-donative property is selected as the dielectric layer, and that the electrostatic image formed on the electrostatic recording material is developed with an electroconductive powdery developer containing a fine powdery of a magnetic material.

BRIEF DESCRIPTION OF THE DRAWING

FIG. 1-A is a diagram illustrating the step of forming an electrostatic latent image in the process of the present invention.

FIG. 1-B is a diagram illustrating the developing step in the process of the present invention.

FIG. 1-C is a diagram illustrating the fixing step in the process of the present invention.

FIG. 2-A is a block diagram illustrating an instance of an output circuit for producing an alternating current recording signal.

FIG. 2-B is a view showing the wave form of a recording signal produced by the output circuit shown in FIG. 2-A.

FIG. 3-A is a block diagram illustrating an instance of an output circuit for producing a recording signal of an asymmetric alternating current biased to the negative polarity side.

FIG. 3-B is a view showing the wave form of a recording signal produced by the output circuit shown in FIG. 3-A.

FIG. 4-A is a block diagram illustrating an instance of an output circuit for producing a recording signal of an asymmetric alternating current biased to the positive polarity side.

FIG. 4-B is a view showing the wave form of a recording signal produced by the output circuit shown in FIG. 4-A.

DETAILED DESCRIPTION OF THE PREFERRED EMBODIMENTS

Figure 5:
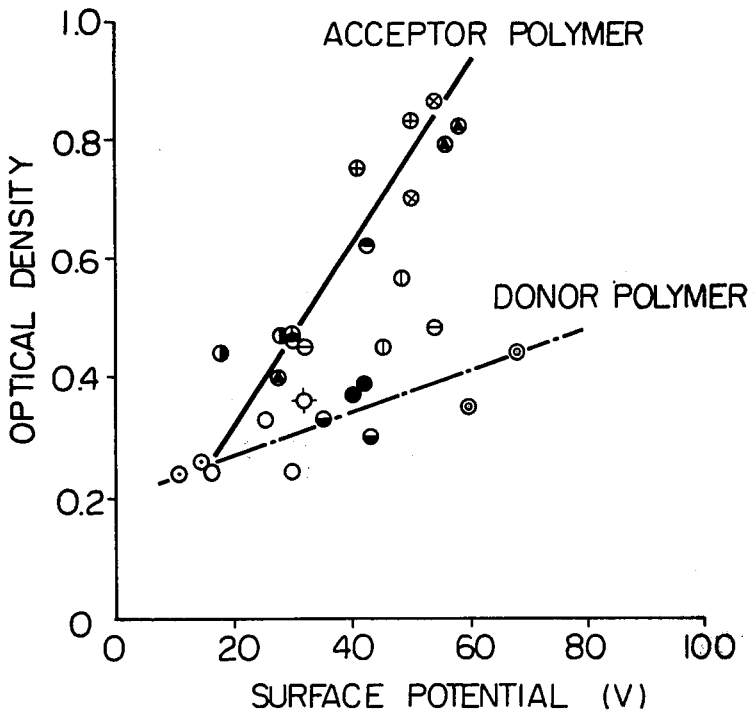
FIG. 5 is a graph illustrating the relation between the surface potential and the optical density in various dielectric layers.

The present invention will now be described in detail.

Referring now to FIGS. 1-A, 1-B and 1-C illustrating the steps of the process of the present invention, an output device 3 for transmitting a high frequency signal of an alternating or asymmetric alternating current formed by amplifying and modulating an image signal is connected to a recording electrode (recording stylus) 1 and a counter electrode 2. Between the electrodes 1 and 2, an electrostatic recording material 4 is disposed so that it is electrically connected to the electrodes 1 and 2. In general, the electrostatic recording material 4 comprises a dielectric material layer 5 detailed hereinafter and an electroconductive layer 6, and the electroconductive layer 6 is located in contact with or in the vicinity of the counter electrode 2 and the dielectric material layer 5 is located in contact with or in the vicinity of the recording electrode 1. By relatively moving the recording electrode 1 and the electrostatic recording material 4 and applying an alternating recording signal of an alternating current or asymmetric alternating current between the two electrodes 1 and 2, an electrostatic latent image 7 charged alternately with charges of reverse polarities is formed on the dielectric material layer 5 depending on the frequency of the recording signal.

At the subsequent developing step shown in FIG. 1-B, the electrostatic latent image 7 formed on the electrostatic recording material 4 is developed with a magnetic electroconductive powdery developer 8. In general, this magnetic electroconductive powdery developer 8 is held in the form of a magnetic brush on a developing roller 9 having a magnet (not shown) disposed in the interior thereof, and when a spike of the magnetic brush falls in contact with the surface of the dielectric material layer of the electrostatic recording material 4, a visible toner image 10 is formed.

At the final fixing step shown in FIG. 1-C, the electrostatic recording material 4 having the visible toner image 10 formed thereon is fed between a pair of press rollers 11 and fixation of the visible toner image 10 is performed under pressure to form a fixed image 12.

In the present invention, a recording signal consisting of a high frequency alternating current or asymmetric alternating current formed by amplifying and modulating an image signal can be synthesized according to any optional means.

For example, a recording signal of an alternating current having a wave form as shown in FIG. 2-B can be synthesized by modifying an image signal 13 by a carrier wave oscillator 14 and a modulator 15 and amplifying the modulated signal by an amplifier 16 in an output circuit shown in FIG. 2-A, and the so synthesized recording recording signal is applied to a recording electrode 1.

A recording signal of an asymmetric alternating current having a wave form biased to the negative polarity side as shown in FIG. 3-B is synthesized by transmitting a modulated signal from the amplifier 16 to a transformer 17 and deviating it to the negative polarity side by a diode 18 and a power source 19 in an output circuit 3-A.

A recording signal of an asymmetric alternating current having a wave form biased to the positive polarity side as shown in FIG. 4-B is synthesized by an output circuit shown in FIG. 4-A in which the polarity connection between the diode 18 and power source 19 is made reverse to that shown in FIG. 3-A.

One of important features of the present invention is that when the recording signal is of an alternating current (FIG. 2-B) or asymmetric alternating current biased to the negative polarity side (FIG. 3-B), a dielectric layer comprising a dielectric substance having an electron-acceptive property (electron acceptor) is selected and when the recording signal is of an asymmetric alternating current biased to the positive polarity side, a dielectric layer comprising a dielectric substance having an electron-donative property (electron donor) is selected.

In the conventional electric recording methods, since the recording layer, namely the dielectric layer, has such a polarity that it is frictionally charged by slinding contact with the electrode, in order to prevent fogging at the developing step, the polarity of the recording voltage is made reverse to the frictional charging polarity of the dielectric layer. More specifically, an electron-donative dielectric layer is ordinarily selected in case of negative charge recording and an electron-donative dielectric layer is ordinarily selected in case of positive charge recording. If a dielectric layer is thus selected, occurrence of fogging can be prevented to some extent at the developing step, but at the recording step, the recording charge is neutralized by the frictional charge of the reverse polarity. Further, at the developing step, the recording charge to be developed is neutralized by the frictional charge generated by contact with the magnetic brush. Accordingly, the surface potential on the dielectric layer is reduced and the sensitivity of development with a toner is inevitably reduced.

In contrast, since a recording signal of an alternating current or asymmetric alternating current is employed, since the polarity of the charge row of the dielectric substance and the polarity of the recording voltage are combined in the above-mentioned manner, fogging is not caused at the developing step and the development sensitivity can be remarkably improved. This fact will be apparent from Examples given hereinafter and test results shown in FIG. 5. FIG. 5 illustrates the relation between the image density (expressed in terms of the optical density because the measurement was conducted with respect to the reflecting density) and the surface potential of the dielectric layer, which was observed when a symmetric alternating current voltage (10 KHz) was applied at a line density of 13 lines per millimeter and a recording speed of 2 m/sec on the dielectric layer composed of an acrylic polymer (○, ⊙, ◉) or saturated polyester (●) as the electron-donative polymer or an acrylic acid estervinyl monomer copolymer (⊖, ⦶), a mixture of a vinyl polymer and a vinyl copolymer (⊕, ⊗, ⦸, ⦶) or a synthetic rubber (◓, ◒, ◮) as the electron-acceptive polymer. The development was carried out by using an electronconductive magnetic powdery developer for heat fixation in each case. From the results shown in FIG. 5, it will readily be understood that when a symmetric alternating current is applied (negatively charge), by using an acceptor polymer (electron-acceptive polymer) for the dielectric layer, recording can be accomplished at a high recording efficiency.

The reason why an electron-acceptive dielectric layer is used in the present invention in case of a recording signal of a symmetric alternating current is that the dielectric layer surface is charged negatively preferentially.

The reason why in the present invention the image density can be remarkably enhanced while effectively eliminating blurring, tailing, fogging and the like by the combined use of a recording signal of an alternating current or asymmetric alternating current, a specific dielectric layer selected depending on the kind of said recording layer and an electroconductive magnetic developer has not been completely elucidated. However, it is construed that such excellent effect may be attained in the following manner.

In the present invention, when a recording signal of a high frequency alternating current or asymmetric alternating current formed by amplifying and modulating an image signal is used, weak alternating charges are applied also on non-image areas and they have an action of cancelling out undesirable charges causing blurring, tailing or fogging. Further, in image areas, the charge characteristic (electron-acceptive or electron-donative property) is in agreement with the charge polarity of the recording signal. Accordingly, an electrostatic latent image having a much higher surface potential than the surface potentials attained by the conventional electrostatic recording methods can be formed on the dielectric layer. Still further, when this electrostatic latent image is developed with an electroconductive magnetic developer, charges of a polarity reverse to that of the electrostatic latent image are induced on particles of the developer by polarization, and only when a Coulomb force between the charges of the electrostatic latent image and the charges of the developer particles is larger than the magnetic force exposed to the developer particles, development of the electrostatic latent image becomes possible. Namely, in the development with a magnetic developer, there is a certain threshold value in connection with the above-mentioned Coulomb force. Therefore, even if weak charges causing blurring, tailing, fogging and the like are present on the dielectric layer, the Coulomb force between these charges and the charges of the developer particles is smaller than said threshold value, and in non-image areas occurrence of such problems as blurring, tailing and fogging can be eliminated while an image having a very high density can be formed in image areas.

Moreover, in the present invention, because of the high frequency of the recording signal, the high surface potential of the dielectric layer and the charge of a polarity reverse to the polarity of the electrostatic latent image, which is generated on the developer particles by polarization, formation of dots in the image can be effectively prevented, and reduction of the image density and occurrence of Moiré can be effectively prevented.

Any of dielectric substances can be used for the dielectric layer 5 in the present invention so far as the foregoing conditions are satisfied. As the electron-donative dielectric substance, there can be mentioned ester group-containing polymers such as acrylic resins, cellulose acetate, polycarbonates, thermoplastic polyesters, polystyrene and styrene-acrylic acid ester copolymers, exemplified in an order of importance. As suitable examples of the electron-acceptive dielectric substance, there can be mentioned halogen-containing polymers such as chlorinated rubbers, chlorinated polypropylene, chlorinated polyethylene, vinylidene chloride resins, vinyl chloride resins, vinyl chloride-vinyl acetate copolymers, partially saponified and acetalized vinyl chloride-vinyl acetate copolymers, vinyl chloride-vinyl acetate-maleic acid copolymers, polytetrafluoroethylene, tetrafluoroethylene-hexafluoropropylene copolymers and polyvinyl fluoride.

It is preferred that the thickness of such dielectric layer be in the range of 5 to 15$\mu$. In order to improve the recording characteristics and appearance characteristics, titanium oxide, barium titanate or finely divide silicic acid (Aerosil) may be incorporated into the dielectric layer.

As the electroconductive substrate on which the dielectric layer is formed, there may be used an electroconductive substrate having a volume resistivity of $10^6$ to $10^9$ $\Omega$-cm, for example, a paper substrate which has been rendered electrically conductive by the treatment with at least one member selected from cationic, anionic and non-ionic polymeric conducting agents, water-soluble inorganic salts, various surface active agents and organic moisture-absorbing agents such as glycerin.

The frequency of the carrier wave of the high frequency signal is not particularly critical in the present invention so far as charges are generated on the dielectric layer. In general, a high frequency of 5 to 800 KHz, especially 10 to 200 KHz, is advantageously selected and used depending on the scanning speed adopted for recording. The wave form is not particularly critical. Namely, not only a sine wave but also chopping, rectangular and saw tooth waves can be used. The voltage to be applied is appropriately chosen within the range of 300 to 1500 V r.m.s., especially 400 to 1300 V r.m.s., depending on the kind and thickness of the dielectric layer.

In the present invention, when a recording signal of an asymmetric alternating current is used, it is preferred that the peak value of the voltage of a polarity reverse to the polarity of the charge to be recorded on the dielectric layer be smaller than the gas discharge initiating voltage. In practising the recording process of the present invention, a changeover switch is disposed in output circuits so that by selecting, for example, an appropriate circuit from the circuits shown in FIGS. 2-A to 4-A, an electrostatic latent image of an optional type can be formed on the dielectric layer of the recording material. In this case, a symmetric alternating current can be used for recording an image of a half tone and an asymmetric alternating current can be used for recording an image of a hard tone.

When the recording speed is low, one stylus can be used as the recording electrode (recording stylus), but when the recording speed is high, electrodes arranged in one line or a plurality of lines (pin electrodes and pin matrix electrodes) and letter type electrodes can be preferably employed.

Relative scanning of the recording electrode and the recording material can be accomplished by any of known scanning methods, for example, a cylinder-rotating scanning method, a disc-rotating scanning method, a belt-driving scanning method, a spiral cylinder-rotating scanning method and a recording head array subsequent change-over scanning method. These scanning methods are described in detail in the report of Mr. Yoshida published in Image Techniques, August 1971, pages 56 to 66.

The speed for relative scanning of the recording electrode and the recording material is varied depending on the frequency of the carrier wave of the high frequency recording signal, but in general, it is preferably chosen within the range of 0.5 to 100 m/sec, especially 1 to 50 m/sec.

Any of powdery developers having a property of being magnetically attracted, an electrically conductive property and a fixing property can be used as the magnetic electroconductive powdery developer in the present invention. In general, a preferred powdery developer having the above three properties is composed of a fine powder of an inorganic magnetic material, a conducting agent and a fixing agent.

As the inorganic magnetic materials customarily used in the art, there can be mentioned, for example, triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). In the present invention, these magnetic materials may be used singly or in the form of a mixture of two or more of them. As the magnetic material especially suitable for attaining the objects of the present invention, there can be mentioned a fine powder of triiron tetroxide or $\gamma$-diiron trioxide.

As the conducting agent, there may be employed fine powdery conducting agents such as carbon black, aluminum powder, copper powder and silver powder, and polymeric conducting agents. Use of conducting agents of the former type, especially carbon black, is preferred.

Any of natural, semi-synthetic and synthetic resins, rubbers and waxes that become adhesive or sticky under application of heat or pressure can be used as the fixing agent in combination with the above-mentioned fine powdery magnetic material and conducting agent. Such resinous binders may be either thermoplastic resins or uncured products or precondensates of thermosetting resins. Valuable natural resins include balsam resins, rosin, shellac and copal. These natural resins may be modified with at least one member selected from vinyl resins, acrylic resins, alkyd resins, phenolic resins, epoxy resins and oleoresins. As the synthetic resin, there can be mentioned, for example, vinyl resins such as vinyl chloride resins, vinylidene chloride resins, vinyl acetate resins, vinyl acetal resins, e.g., polyvinyl butyral, and vinyl ether polymers, acrylic resins such as polyacrylic acid esters, polymethacrylic acid esters, acrylic acid copolymers and methacrylic acid copolymers, olefin resins such as polyethylene, polypropylene, polystryrene, hydrogenated styrene resins, ethylene-vinyl acetate copolymers and tyrene copolymers, polyamide resins such as nylon 12, nylon 6 and polymeric fatty acid-modified polyamides, polyesters such as polyethylene terephthalate/isophthalate and polytetramethylene terephthalate/isophthalate, alkyd resins such as phthalic acid resins and maleic acid resins, phenol-formaldehyde resins, ketone resins, coumarone-indene resins, amino resins such as urea-formaldehyde resins and melamine-formaldehyde resins, and epoxy resins. These synthetic resins may be used in the form of a mixture of two or more of them, for example, a mixture of a phenolic resin and an epoxy resin or a mixture of an amino resin and an epoxy resin.

As the natural or synthetic rubbery material, there can be mentioned, for example, natural rubber, chlorinated rubber, cyclized rubber, polyisobutylene, ethylene-propylene rubber (EPR), ethylene-propylene-diene rubber (EPDM), polybutadiene, butyl rubber, styrene-butadiene rubber (SBR) and acrylonitrile-butadiene rubber (ABR).

As the natural, synthetic or modified wax, there can be mentioned, for example, paraffin wax, petrolatum, polyethylene wax, microcrystalline wax, bees wax, hydrous lanolin, cotton wax, carnauba wax, montan wax, hydrogenated beef tallow, higher fatty acids, higher fatty acid amides, soaps and other higher fatty acid derivatives.

In general, in the present invention it is preferred to use a developer comprising 100 parts by weight of a fine powder of a magnetic material, 10 to 150 parts by weight, especially 25 to 100 parts by weight, of a binder and 1 to 30 parts by weight, especially 3 to 20 parts by weight, of a conducting agent. A binder composed solely of a resin or a binder comprising 55 to 95% by weight of a resin and 5 to 45% by weight of a wax is preferably employed. The developer is obtained by dispersing a fine powder of a magnetic material and at least a part of a conducting agent into a melt or solution of a binder as mentioned above and shaping the dispersion into fine particles. If desired, in order to further enhance the electric conductivity or flowability of the so formed particles, the remainder of the conducting agent is dry-blended in the particles to crumb or embed the conducting agent on the surfaces of the particles.

The electroconductive magnetic powdery developer that is suitably used for attaining the objects of the present invention has a particle size of 1 to 30μ, especially 2 to 10μ, and a volume resistivity lower than $10^9$ Ω-cm, especially $10^4$ to $10^8$ Ω-cm.

The so-called magnetic brush developing method is used for developing an electrostatic latent image on the recording material with the above-mentioned electroconductive magnetic developer. One of the features of the present invention is that a particular magnetic carrier need not be used for the development. According to the magnetic brush developing method, magnetic brushes of the electroconductive magnetic powdery developer are formed on a rotary sleeve having a magnet disposed in the interior thereof, and the surface of the recording material having an electrostatic latent image formed thereon is caused to fall in contact with these magnetic brushes, thereby to form a visible toner image. The surface of the rotary sleeve may be formed of either an electrically conductive material such as a metal or an electrically insulating material. In the former case, the surface of the rotary sleeve is earthed and a conducting passage is formed between the surface of the rotary sleeve and the spike of the magnetic brush as the developing electrode. In the latter case, a conducting passage is formed between the surface of the rotary sleeve and the magnetic brush composed of the developer particles so that charges having a polarity reverse to that of charges to be developed are induced on the spike of the magnetic brush.

An image of the developer particles formed on the recording material may be fixed on the surface of the recording material by optional fixing means, for example, pressure fixation, heating fixation and solvent fixation. According to the pressure fixing method, the fixation can be accomplished very easily at a high speed only by passing the recording material through a pair of pressure rollers. Further, no time is necessary for warming up the fixing apparatus. Accordingly, the pressure fixing method is very advantageous for attaining the objects of the present invention. In general, it is preferred that the linear pressure applied to the press rollers be at least 15 Kg per cm of the roller length, especially at least 30 Kg per cm of the roller length. Further, when the pressure fixing method is adopted, a developer comprising a mixture of a resin and a wax as the binder is advantageously used. According to the heating fixing method, fixation can be advantageously accomplished by contacting the recording material having a toner image with a roller equipped with heating means, and a roller having a heat-resistant and inactive coating composed of polytetrafluoroethylene, a silicone resin or the like and having an offset preventing agent, such as a silicone oil, applied to the surface of the coating is advantageously used as the heating roller. Such offset preventing agent may be incorporated into the developer per se instead of coating the offset preventing agent on the surface of the heating roller.

In the present invention, when the above-mentioned high frequency alternating current or asymmetric alternating current recording signal, a specific dielectric layer selected depending on the kind of the recording signal and an electroconductive magnetic powdery developer are used in combination for electric recording, there can be attained an unexpected and prominent advantage that such problems as blurring, tailing, fogging and Moire can be completely eliminated and clear recorded images having a remarkably high density can be obtained.

The electric recording process of the present invention can be advantageously applied to facsimile, electrostatic printing, a printer of a computor and the like, and it provides an effect of forming at high speeds recorded images free of such defects as blurring, tailing, fogging and Moiré.

The present invention will now be described by reference to the following Examples that by no means limit the scope of the invention.

EXAMPLE 1

A polymeric material described below was coated on a base paper having a thickness of 65μ and a volume resistivity of $8 \times 10^7$ Ω-cm (as measured at 20° C. and 58% RH) to form a dielectric layer having a dry thickness of 11μ.

Electron-donative resin (positively charged by friction):

Acrylic resin (Dianal LR-297 manufactured by Mitsubishi Rayon) in the form of a solution in toluene Electron-acceptive resin (negatively charged by fricton):

Vinyl chloride-containing copolymer (Slec A manufactured by Sekisui Kagaku Kogyo)

The so prepared recording paper was attached to a metal drum, and a symmetric alternating current of 1200 $V_{p-p}$ or an asymmetric alternating current voltage formed by overlapping a symmetric alternating current of 800 $V_{p-p}$ (frequency = 10 KHz) on a positive direct current of 200 V was applied and scanning recording was carried out under the following conditions:

Stylus pressure: 10 g
Line density: 10 lines/mm
Recording speed: 2m/sec

The recorded electrostatic image was developed with an electroconductive powdery developer containing a finely divided magnetic material (manufactured by Mita Kogyo), and the developed image was heat-fixed and the reflection density was determined. Just after recording, the surface potential of the recording paper was measured by an electrostatic paper analyzer (Model SP-428 manufactured by Kawaguchi Denki). Obtained results are shown in Table 1.

Table 1

| | Symmetric Alternating Current (negative charge) | | Asymmetric Alternating Current (positive charge) | |
|---|---|---|---|---|
| Dielectric Layer | surface potential | reflection density | surface potential | reflection density |
| Acrylic resin | −11 V | 0.24 | +96 V | 0.85 |
| Vinyl chloride copolymer | −56 V | 0.82 | +28 V | 0.37 |

From the results shown in Table 1, it will readily be understood that when an electron-acceptive resin is used for the dielectric layer in case of a symmetric alternating current recording signal (negative charge) or an electron-donative resin is used for the dielectric layer in case of an asymmetric alternating current biased to the positve polarity side (positive charge), the polarity characteristic is matched with the recording polarity, and electrostatic recording can be accomplished at a high recording efficiency.

EXAMPLE 2

In the same manner as described in Example 1, dielectric layers having a dry thickness of 10μ were prepared by using an acrylic resin (Acrydic 7-1027 manufactured by Dainippon Ink Kagaku) as the electron-donative resin and a chlorinated rubber (CR-40 manufactured by Asahi Denka Kogyo) as the electron-acceptive resin. The resulting recording papers were tested in the same manner as described in Example 1 to obtain results shown in Table 2.

Table 2

| | Symmetric Alternating Current (negative charge) | | Asymmetric Alternating Current (positive charge) | |
|---|---|---|---|---|
| Dielectric Layer | surface potential | reflection density | surface potential | reflection density |
| Acrylic resin | −17 V | 0.24 | +140 V | 1.05 |
| Chlorinated rubber | −60 V | 0.85 | +30 V | 0.35 |

From the results shown in Table 2, it will readily be understood that when the polarity of the recording alternating current is matched with the polarity of the dielectric layer, electrostatic recording can be accomplished at a high recording efficiency.

EXAMPLE 3

Dielectric layers having a dry thickness of 8μ were formed on the same base papers as used in Example 1 by using a saturated polyester resin (Vylon 200 manufactured by Toyo Boseki) as the electron-donative resin or chlorinated polypropylene (manufactured by Sanyo Kokusaku Pulp) as the electron-acceptive resin. Each recording paper was attached to a metal drum, and an asymmetric alternating current biased to the positive or negative polarity side, which was formed by overlapping a symmetric alternating current of 800 $V_{p-p}$ (frequency = 50 KHz) on a positive or negative direct current voltage of 200 V, was applied and scanned on the recording paper under a stylus pressure of 15 g at a line density of 10 lines/mm and a recording speed of 3.8 m/sec. After recording, development was carried out by using a magnetic electroconductive powdery developer for pressure fixation (manufactured by Mita Kogyo) and the recording paper was passed through between pressing rollers to effect pressure fixation. The reflection density was then determined. Separately, just after recording, the surface potential was measured. Obtained results are shown in Table 3.

Table 3

| | Asymmetric Alternating Current (negative charge) | | Asymmetric Alternating Current (positive charge) | |
|---|---|---|---|---|
| Dielectric Layer | surface potential | reflection density | surface potential | reflection density |
| Saturated polyester | −60 V | 0.47 | +120 V | 1.10 |
| Chlorinated polypropylene | −70 V | 0.85 | + 10 V | 0.17 |

From the results shown in Table 3, it will readily be understood that when the polarity of the recording alternating current is matched with the polarity of the dielectric layer, electrostatic recording can be accomplished at a high recording efficiency.

EXAMPLE 4

The electrostatic recording paper prepared in Example 1 was pasted on a signal receiving drum of an electrostatic recording machine and a test chart No. 2 specified by the Japanese Society of Image Electronics was set on a signal emitting drum. A recording voltage was applied to a tungsten stylus having a diameter of 150μ under a stylus pressure of 10 g at a line density of 13 lines/mm and a recording speed of 3.5 m/sec with a carrier wave having a frequency of 20 KHz from a recording signal output zone capable of overlapping an amplified and modulated wave to a positive direct current voltage of 200 V and the stylus was scanned on the electrostatic recording paper. After completion of recording, development was carried out by using a liquid developer for positive charging or a magnetic electroconductive powdery developer for heat fixation, followed by fixation. Obtained results are shown in Table 4.

Table 4

| Developer | Dielectric Layer | Fogging | Tailing | Blurring | Moire | Image Density* |
|---|---|---|---|---|---|---|
| liquid developer | acrylic resin | observed | not observed | not observed | observed | 0.80 |
| " | vinyl chloride copolymer | not observed | not observed | not observed | observed | 0.65 |
| magnetic developer | acrylic resin | not observed | not observed | not observed | not observed | 1.20 |
| " | vinyl chloride copolymer | not observed | not observed | not observed | not observed | 0.40 |

*the reflection density was measured on shear black portions

As will be apparent from the results shown in Table 4, according to the present invention characterized by specific combination of the alternating current recording signal, magnetic developer and specifically selected dielectric layer polarity, electrostatic recording can be performed at a high efficiency and recorded images having a high density and free of fogging, tailing, blurring and Moiré can be obtained.

When the above test was conducted in the same manner except that the amplified and modulated wave was overlapped on a negative direct current voltage, the electrostatic recording paper having a dielectric layer of the electron-acceptive vinyl chloride copolymer provided a recorded image having a high density and free of fogging, tailing, blurring and Moiré.

EXAMPLE 5

The electrostatic recording paper prepared in Example 2 was tested in the same manner as in Example 4 except that the frequency of the carrier wave was changed to 50 KHz and the amplified and modulated wave was overlapped on a negative direct current voltage of 200 V. Obtained results are shown in Table 5. Development was carried out by using a dry powdery developer for negative charging or a magnetic developer for pressure fixation.

Table 5

| Developer | Dielectric Layer | Fogging | Tailing | Blurring | Moire | Image Density |
|---|---|---|---|---|---|---|
| powdery developer | acrylic resin | not observed | not observed | not observed | observed | 0.70 |
| " | chlorinated rubber | slightly observed | not observed | not observed | observed | 0.75 |
| magnetic developer | acrylic resin | not observed | not observed | not observed | not observed | 0.31 |
| " | chlorinated rubber | not observed | not observed | not observed | not observed | 1.05 |

As will be apparent from the results shown in Table 5, according to the present invention characterized by specific combination of the alternating current recording signal, magnetic developer and specifically selected polarity of the dielectric layer, electrostatic recording can be accomplished at a high efficiency and recorded images having a high density and free of fogging, tailing, blurring and Moiré can be obtained.

When the above test was conducted in the same manner except that the amplified and modulated wave was overlapped on a positive direct current voltage, the electrostatic recording paper having a dielectric layer of the electron-acceptive acrylic resin provided a recorded image having a high image quality.

What we claim is:

1. An electrostatic recording process comprising relatively scanning a recording electrode on an electrostatic recording material which is electrically connected between said recording electrode and a counter electrode, applying a high frequency alternating current recording signal formed by modulating an image signal by a high frequency carrier wave between said two electrodes to form an electrostatic image on the electrostatic recording material, developing the so formed electrostatic image with a developer and fixing the developed image, said process being characterized in that said electrostatic recording material comprises an electroconductive layer and a dielectric layer comprising a dielectric substance having an electron-acceptive property and that the electrostatic image formed on the electrostatic recording material is developed with an electroconductive powdery developer containing a fine powder of a magnetic material.

2. An electric recording process according to claim 1 wherein the electron-acceptive dielectric substance is a halogen-containing polymer.

3. An electric recording process according to claim 1 wherein a carrier wave of said recording signal has a frequency of 5 to 800 KHz.

4. An electric recording process according to claim 1 wherein the electrostatic image is developed with a magnetic brush of the electroconductive powdery developer.

5. An electric recording process according to claim 1 wherein the electroconductive powdery developer is a fine particulate developer comprising 100 parts by weight of a fine powder of an inorganic magnetic material, 25 to 100 parts by weight of a binder and 3 to 20 parts by weight of a conducting agent.

6. An electric recording process according to claim 5, wherein the fine particulate developer has a volume resistivity of $10^4$ to $10^9$ Ω-cm.

7. An electric recording process according to claim 1 wherein the developer has a volume resistivity of $10^4$ to $10^9$ Ω-cm.

8. An electrostatic recording process comprising relatively scanning a recording electrode on an electrostatic recording material which is electrically connected between said recording electrode and a counter electrode, applying a high frequency asymmetric alternating current recording signal formed by modulating an image signal by a high frequency carrier wave between said two electrodes to form an electrostatic image on the electrostatic recording material, developing the so formed electrostatic image with a developer and fixing the developed image, said process being characterized in that said electrostatic recording material comprises an electroconductive layer and a dielectric layer and wherein said recording signal is a signal of an asymmetric alternating current biased to the positive polarity side, the dielectric layer comprises a dielectric substance having an electron-donative property, and when said recording signal is a signal of an asymmetric alternating current biased to the negative polarity side, the dielectric layer comprises a dielectric substance having an electron-acceptive property, and that the electrostatic image formed on the electrostatic recording material is developed with an electroconductive powdery developer containing a fine powder of a magnetic material.

9. An electric recording process according to claim 8 wherein the electron-donative dielectric substance is an ester group-containing polymer.

10. An electric recording process according to claim 8 wherein said recording signal is of an asymmetric alternating current in which the peak value of a voltage of a polarity reverse to the polarity of the charge to be recorded on the dielectric layer is smaller than the gas discharge initiating voltage.

11. An electrostatic recording process according to claim 1 wherein the electron-acceptive dielectric substance is a halogen-containing polymer.

12. An electrostatic recording process according to claim 8 wherein a carrier wave of said recording signal has a frequency of 5 to 800 KHz.

13. An electrostatic recording process according to claim 8 wherein the electrostatic image is developed with a magnetic brush of the electroconductive powdery developer.

14. An electrostatic recording process according to claim 8 wherein the electroconductive powdery developer is a fine particulate developer comprising 100 parts by weight of a fine powder of an inorganic magnetic material, 25 to 100 parts by weight of a binder and 3 to 20 parts by weight of a conducting agent.

15. An electrostatic recording process according to claim 8 wherein the developer has a volume resistivity of $10^4$ to $10^9$ Ω-cm.

* * * * *